US005577443A

United States Patent [19]

Songer

[11] Patent Number: 5,577,443

[45] Date of Patent: Nov. 26, 1996

[54] PRINTING SLEEVE CONSTRUCTION

[75] Inventor: Richard F. Songer, Ellicottville, N.Y.

[73] Assignee: Luminite Products Corporation, Salamanca, N.Y.

[21] Appl. No.: 386,353

[22] Filed: Feb. 8, 1995

[51] Int. Cl.[6] ..... B41F 27/00

[52] U.S. Cl. ..... 101/375; 492/48; 492/56

[58] Field of Search ..... 101/216, 217, 101/375, 376, 401.1; 492/18, 48, 56

[56] References Cited

U.S. PATENT DOCUMENTS

| | | | |
|---|---|---|---|
| 3,130,670 | 4/1964 | Macy | 101/376 |
| 3,146,709 | 9/1964 | Bass et al. | 101/375 |
| 3,254,599 | 6/1966 | Karlquist | 101/376 |
| 3,261,289 | 7/1966 | Cash et al. | 101/426 |
| 3,802,952 | 4/1974 | Gurin et al. | 101/217 |
| 3,978,254 | 8/1976 | Hoexter et al. | 428/36 |
| 4,007,680 | 2/1977 | Pfleger et al. | 101/153 |
| 4,030,415 | 6/1977 | Fellows | 101/382.1 |
| 4,144,812 | 3/1979 | Julian | 101/382.1 |
| 4,144,813 | 3/1979 | Julian | 101/382.1 |
| 4,246,842 | 1/1981 | Williams et al. | 101/367 |
| 4,391,898 | 7/1983 | van der Velden | 430/306 |
| 4,601,928 | 7/1986 | van der Velden | 428/36 |
| 4,903,597 | 2/1990 | Hoage et al. | 101/401.1 |
| 5,205,213 | 4/1993 | Bresson | 101/217 |

*Primary Examiner*—Stephen R. Funk
*Attorney, Agent, or Firm*—Joseph P. Gastel

[57] ABSTRACT

A printing sleeve including a nickel sleeve having an inner surface and an outer surface and opposite ends and a hard rubber layer bonded to the outer surface and having end portions extending beyond the opposite ends of the nickel sleeve, and an inner surface on the end portions of the hard rubber layer which are substantially in line with the inner surface of the nickel sleeve.

22 Claims, 2 Drawing Sheets

Fig. 1.
PRIOR ART
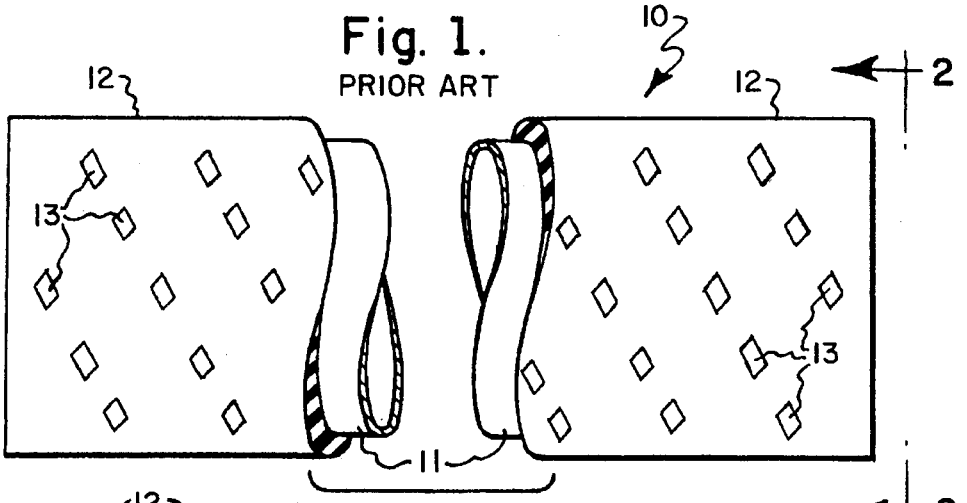
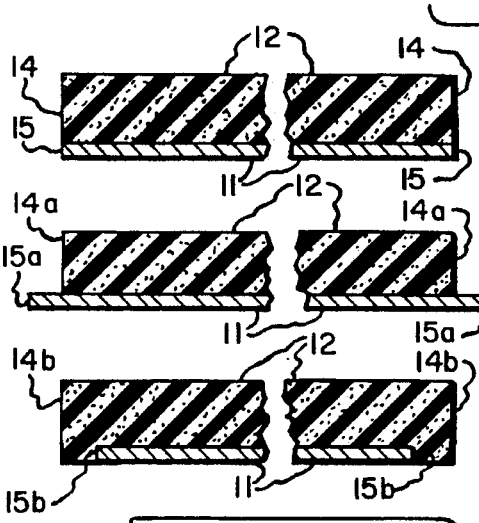
Fig. 3.
PRIOR ART
Fig. 3A.
PRIOR ART
Fig. 3B.
PRIOR ART
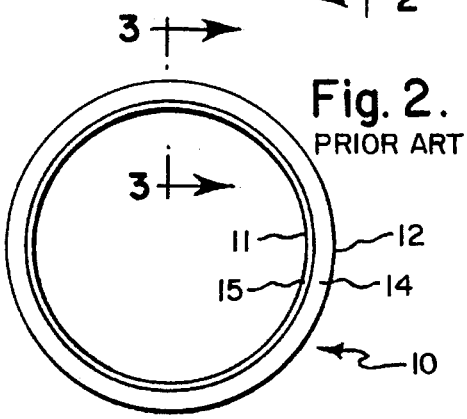
Fig. 2.
PRIOR ART
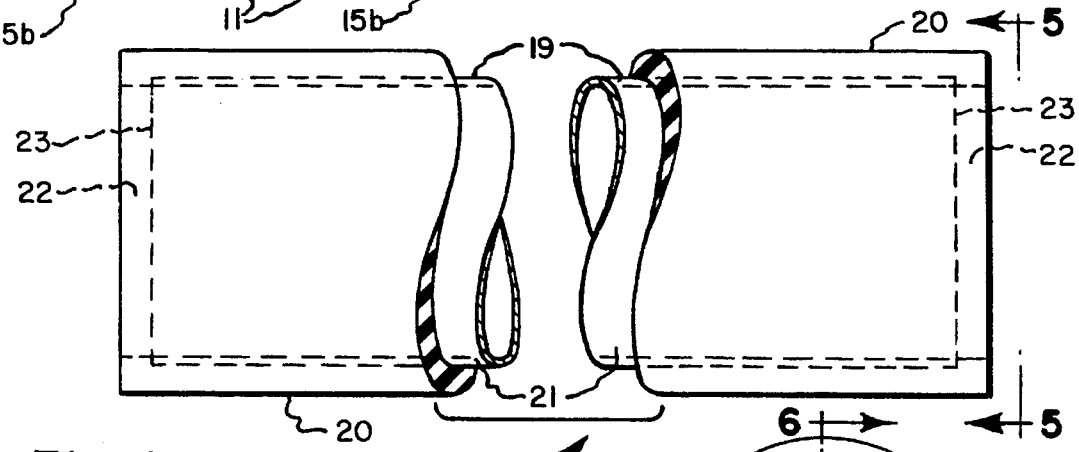
Fig. 4.
Fig. 6.
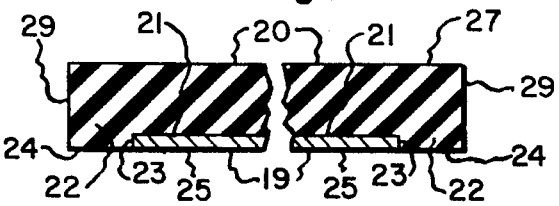
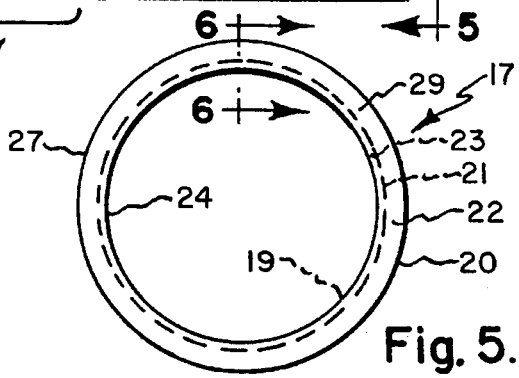
Fig. 5.

PRINTING SLEEVE CONSTRUCTION

BACKGROUND OF THE INVENTION

The present invention relates to an improved printing sleeve construction.

By way of background, there are in common usage nickel printing sleeves or cylinders onto which printing plates are mounted or outer rubber printing layers are bonded, as well known in the art. The metal sleeves are between 0.005 and 0.007 inches thick and can be expanded by air pressure produced in a mandrel as they are mounted thereon. However, these metal sleeves, which are in common usage, have certain deficiencies. They crack or split easily at their ends and they crinkle easily when struck. Furthermore, workmen can be cut on their sharp ends when they are mounted and demounted from an associated mandrel. Additionally, when they have a rubber printing layer bonded thereto, the ends of the rubber printing layer may not be even with the ends of the nickel sleeve. Therefore the protruding ends of the nickel sleeve will still cut workmen when they protrude beyond the rubber layer or there can be difficulty in mounting the sleeves on an associated mandrel when the ends of the rubber printing layer extend beyond the ends of the nickel sleeve.

SUMMARY OF THE INVENTION

It is accordingly the object of the present invention to provide an improved printing sleeve incorporating a nickel sleeve which is resistant to cracking, splitting and crinkling and which will not cut workmen which handle it and which can be reliably mounted and dismounted from an associated mandrel. Other objects and attendant advantages of the present invention will readily be perceived hereafter.

The present invention relates to a printing sleeve comprising a nickel sleeve having an inner surface and an outer surface and opposite ends, and a hard rubber layer bonded to said outer surface and having end portions extending beyond said opposite ends of said nickel sleeve and having an inner surface on said end portions which are in line with said inner surface of said nickel sleeve.

The various aspects of the present invention will be more fully understood when the following portions of the specification are read in conjunction with the accompanying drawings wherein:

BRIEF DESCRIPTION OF THE DRAWINGS

FIG. 1 is a fragmentary side elevational view, partially broken away, of a prior art printing sleeve;

FIG. 2 is an end view of the prior art printing sleeve taken substantially in the direction of arrows 2—2 of FIG. 1;

FIG. 3 is a fragmentary cross sectional view of the prior art printing sleeve taken substantially along line 3—3 of FIG. 2;

FIG. 3A is a fragmentary cross sectional view similar to FIG. 3 but showing a common improper construction of the prior art printing sleeve of FIG. 1;

FIG. 3B is a fragmentary cross sectional view similar to FIG. 3 but showing another common improper construction of the prior art printing sleeve of FIG. 1;

FIG. 4 is a fragmentary side elevational view, partially broken away, of the improved printing sleeve of the present invention;

FIG. 5 is an end elevational view of the printing sleeve of FIG. 4 taken substantially in the direction of arrows 5—5 of FIG. 4;

FIG. 6 is a fragmentary cross sectional view taken substantially along line 6—6 of FIG. 5;

DESCRIPTION OF THE PREFERRED EMBODIMENTS

Figure 7:
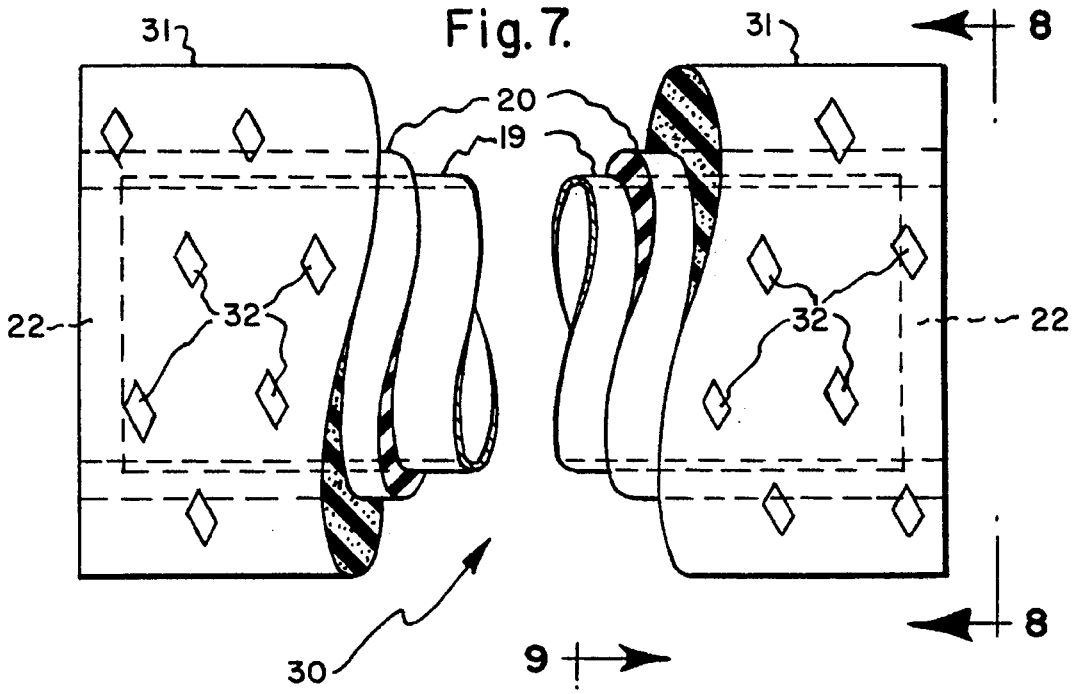
FIG. 7 is a fragmentary side elevational view partially broken away of the improved printing sleeve structure of FIG. 4 with a printing layer mounted thereon.

By way of introduction, the improved printing sleeve of the present invention overcomes the deficiencies of the prior art by limiting the possibility of the nickel sleeve portion (1) to cracking or wrinkling at its ends or (2) flattening into an oval or (3) to crinkling intermediate its ends or (4) to having sharp surfaces at its ends which could cut workmen or (5) to being unable to be removed from an associated mandrel if the crack occurred at its ends or (6) to being unable to be reliably mounted or dismounted from a mandrel if the soft printing rubber bonded thereto extended beyond the ends of the nickel sleeve.

The prior art printing sleeve 10 of FIGS. 1–3, 3A and 3B included a nickel cylinder or sleeve 11 between 0.005 and 0.007 inches thick having bonded thereon a printing layer of relatively soft printing rubber 12 of suitable thickness having a pattern 13 thereon. The optimum construction of the prior art is shown in FIG. 3 wherein the ends 14 of the printing layer 12 are flush with the ends 15 of the nickel sleeve 11. However, common improper constructions are shown in FIGS. 3A and 3B wherein the ends of the printing layer 12 are not flush with the ends of the nickel sleeve. More specifically, in FIG. 3A the ends 15*a* of nickel sleeve 11 extend outwardly beyond the ends 14*a* of printing layer 12. In FIG. 3B the ends 14*b* of printing layer 12 extend outwardly beyond the ends 15*b* of nickel sleeve 11. The shortcoming of the improper construction of FIG. 3A was that the exposed knife-edge sharp ends 15*a* could contribute toward the cutting of the hands of a workmen as they placed the printing sleeve onto a mandrel. In fact, this cutting could also be experienced with the exposed ends 15 as shown in FIG. 3. Additionally, relative to FIG. 3A, the fact that the metal extended beyond the printing layer 12 made the ends 15*a* more susceptible to damage, crinkling, cracking and splitting. The deficiency of the improper construction shown in FIG. 3B is that it was often difficult to mount and dismount this structure onto an air mandrel because the air pressure from the mandrel would deflect the soft printing rubber 12 which in turn would reroute the pressurized air so that it could not expand nickel sleeve 11 so that it could be mounted or dismounted from the mandrel. Further relative to the structure of FIG. 3A, if the cracks occurred at the ends 15*a* after the printing sleeve was mounted on a mandrel, it could not be removed because the sleeve could not be expanded by the air pressure provided by the mandrel. It will be appreciated that the air mandrel which has been referred to may be of any of the conventional constructions well known in the art which supply pressurized air through orifices at the end of the mandrel at pressures less than 100 psi, and preferably at about 75 psi.

The improved base printing sleeve 17 of FIGS. 4–6 overcomes the foregoing deficiencies of the prior art represented in FIGS. 1–3, 3A and 3B. More specifically, the printing sleeve 17 includes an inner nickel sleeve 19 having a stabilizing layer of hard rubber 20 bonded to its outer surface 21 and having end portions 22 which extend beyond the opposite ends 23 of the nickel sleeve which have inner surfaces 24 which are in line with the inner surface 25 of the nickel sleeve 19. The hard rubber 20 is harder than the soft printing rubber of 12 of FIG. 1 and is therefore not subject to the deficiency of the construction of FIG. 3B.

The stabilizing hard rubber outer layer 20 serves a plurality of functions while not adding objectionable resistance to the expandability of nickel sleeve 21 by pressurized air, as required during the mounting thereof onto a mandrel. This is due to the fact layer 20 is sufficiently thin, namely, it is less than about 0.125 inches thick and is preferably between about 0.040 and 0.060 inches thick at end portions 22. However, the hard rubber layer 20 can be of any suitable thickness over 0.125 inches which will still permit it to be expanded by air pressure used to mount it on a mandrel. One difference between the outer layer 20 of FIG. 4 and the outer layer 12 of the prior art sleeve of FIG. 1 is that the latter usually has a Shore A hardness of between about 40 and 60 and occasionally up to 75, whereas the hardness of layer 20 of FIG. 4 has a Shore A hardness of between about 85 and 98 and more preferably between about 90 and 95. The end portions 22 of outer layer 20 (FIG. 6), which extend beyond the ends 23 of metal sleeve 19, have sufficient strength so as to act like the metal sleeve 19 during the conventional mounting and dismounting of the sleeve from an associated mandrel by the use of air pressure, even though there is no bond between end portions 22 and end surfaces 23 of nickel sleeve 19. Thus, when an end portion 22 is placed onto a mandrel during the mounting of sleeve 17 or when the end portion 22 is placed over associated air jets of a mandrel during dismounting, these end portions are strong enough so that they will lift in the same manner and in substantially the same amount as the adjacent portions of nickel sleeve 19. Thus, the printing sleeve 17 consisting of nickel sleeve 19 and hard rubber layer 20 functions substantially exactly like a metal sleeve 19 but adds thereto the advantages that sharp ends, such as 15 and 15*a* of FIGS. 3 and 3A, are covered so that they cannot cut workmen and the ends of sleeve 19 are protected by the end portions 22 of the hard rubber layer against cracking, splitting and crinkling. Furthermore, the hardness of the outer surface 27 of layer 20 protects the outer surface 21 of metal sleeve 19 against crinkling as a result of being struck. Additionally, the end portions 22 thereof serve as a base when the ends 29 of the sleeves 17 rest on a surface for storage.

A hard rubber layer 20 which has been found satisfactory is an ethylene propylene diene monomer material (EPDM) having the physical characteristics which permit it to be expanded by relatively low air pressure so that it will not appreciably increase the amount of air pressure required to expand the nickel sleeve 19 to which it is bonded. The foregoing characteristics are believed to be due to a combination of its hardness, tensile strength, Young's modulus and modulus of stretchability. More specifically, a preferred embodiment of EPDM layer 20 may have a Shore A hardness of between about 85 and 98, and preferably between about 90 and 95, a tensile strength of between about 1700 and 2300 psi, a 100% modulus of stretchability (the force required to stretch the material 100% when the material stretches as much as 100%) of between about 1700 and 2200 psi, and preferably between about 1800 and 2000 psi, a Young's modulus of between about 21,000 and 25,000 psi, an elongation (the elongation before rupture) of between about 40% and 120%, and preferably between about 75% and 120%, and a thermal coefficient of expansion of between about 0.0001 and 0.00001 inches per inch per degree centigrade. The layer 20 can have a thickness of between about 0.040 and 0.10 inches at its ends 22 and preferably between about 0.040 and 0.060 inches at its ends 22, which would cause the thickness of the central portion of layer 20 between end portions 22 to be less than the thickness of end portions 22 by the thickness of the nickel sleeve 19 which, as noted above, is between 0.005 and 0.007 inches thick. In the latter respect, the thickness of nickel sleeve 19 is preferably 0.007 inches when the diameter of sleeve 19 is approximately 9 inches. In short, the hard rubber layer 20 as described above serves the function of protecting nickel sleeve 19 against the above-enumerated disadvantages of the prior art while not appreciably decreasing its expandability as required for mounting and demounting by air pressure on a mandrel. While the hard rubber layer described above is an EPDM material, it will be appreciated that other hard rubbers which will function like the described EPDM rubber can also be used, and therefore it will be appreciated that the present invention is not limited to the EPDM material.

The layer 20 is bonded to nickel sleeve 19 by applying conventional rubber adhesive to the outer surface of the nickel sleeve and thereafter winding rubber strips spirally around nickel sleeve 19, which is mounted on a suitable cylindrical form, and causing the rubber strips to extend beyond the ends 23 and onto the cylindrical form. Thereafter, a strip of nylon shrink-wrap is spirally wound around the rubber and the entire assembly is heated by steam at the desired temperature of approximately 300° for the required period of time of about three hours to cause the layer 27 to vulcanize and cause the rubber adhesive to bond the hard rubber layer to the outer surface 21 of sleeve 19. Thereafter, the outer surface of layer 20 and the ends 29 of end portions 22 are ground to size. The foregoing technique of applying a rubber layer to a cylindrical surface is well known in the art and forms no specific aspect of the present invention other than to denote broadly how the printing sleeve 17 is made. In fact, the layer 20 of FIG. 4 is applied in the same conventional manner as the layer 12 of the prior art sleeve 10 of FIG. 1, which is well known in the art.

Figure 8:
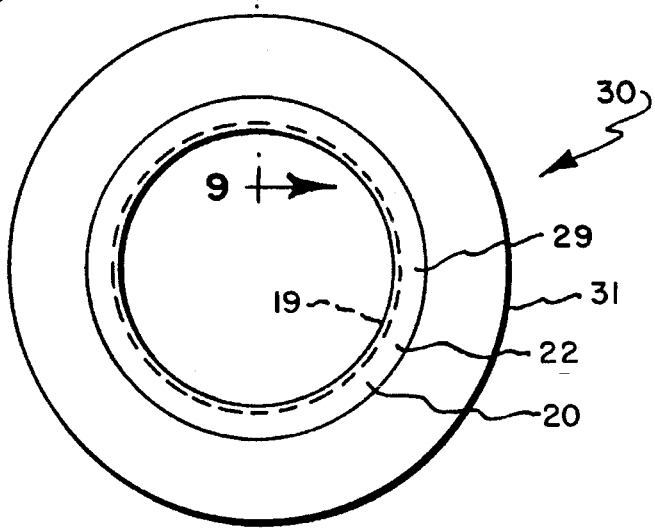
FIG. 8 is an end elevational view taken substantially in the direction of arrows 8—8 of FIG. 7.
Figure 9:
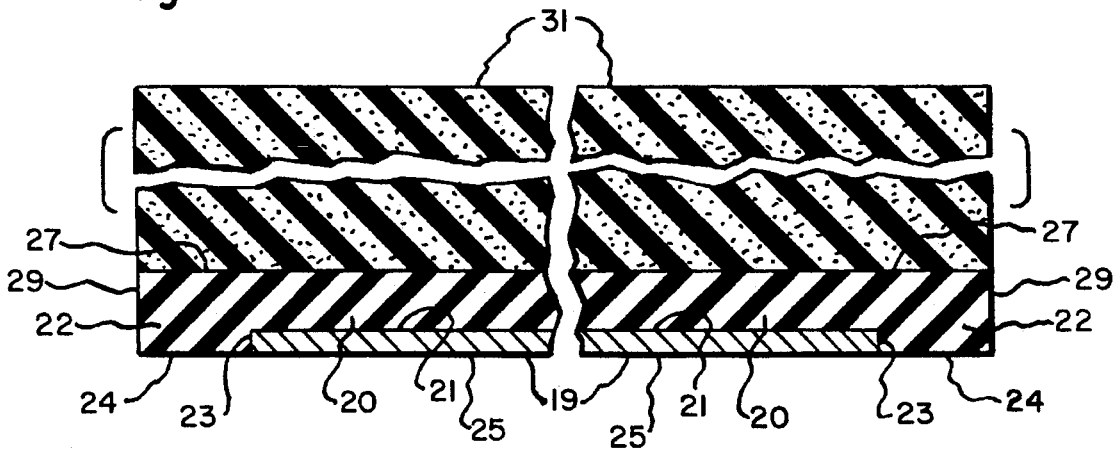
FIG. 9 is a fragmentary cross sectional view taken substantially along line 9—9 of FIG. 8.

The printing sleeve 17 of FIGS. 4–6 can be utilized in one of two ways. It can comprise a base for printing plates which are secured thereto in the conventional manner known in the art or it can be utilized as shown in FIGS. 7–9 wherein a printing sleeve 30 is fabricated by applying a soft rubber printing layer 31 onto hard rubber layer 20 which has been previously bonded to metal sleeve 19, as described above. The outer layer 31 has a pattern produced thereon in a conventional manner after its surface has been ground in the conventional manner and after it has been cross linked to hard rubber layer 20 in the conventional manner. More specifically, the outer layer 21 is wound onto the outer surface 27 of hard rubber layer 20 in spiral strips and then wound with shrink-wrap and heated with steam at 300° until it cross links into the surface 27 of layer 20, in a manner known in the art.

By way of dimensions, as noted above, nickel sleeve 19 is between 0.005 and 0.007 inches thick and if sleeve 19 is approximately 9 inches in diameter, the 0.007 inch thickness is used therefor. Certain dimensions of layer 20 were set forth above, and end portions 22 have an axial length of about 0.25 inches. Printing layer 31 can be anywhere between about 0.25 and 0.75 inches thick, as desired, and it may comprise any suitable rubber compound including but not limited to natural rubber or synthetic rubbers such as neoprene, nitrile rubber, nitrile-PVC rubber blend, butyl rubber or silicone rubber. The outer layer 31 can have a Shore A hardness of between about 40 and 60. The outer sleeve can have any conventional physical characteristics known in the art which do not contribute significantly to resisting expansion of the sleeve 17 of FIGS. 4–6 by the air pressures which are used to expand the base sleeve 17 during its mounting and demounting from an associated mandrel. Furthermore, the sleeves such as 17 of FIG. 4 and 30 of FIG. 7 may be anywhere between 8 and 80 inches long, and the end portions 22 can be about 0.25 inches in axial length.

It will be appreciated that the drawings are not to scale and that the dimensions have been exaggerated for purposes of illustration. It will also be noted that the cross hatching of the soft printing rubber of FIGS. 3, 3A and 3B differs from the cross hatching of the hard rubber of FIGS. 6 and 9 to show that they are of different hardness. However, it is to be especially noted that the soft rubber of FIGS. 3, 3A and 3B is a solid rubber and not a porous rubber such as foam rubber even though the cross hatching is slightly stippled.

While preferred embodiments of the present invention have been disclosed, it will be appreciated that it is not limited thereto but may be otherwise embodied within the scope of the following claims.

What is claimed is:

1. A printing sleeve comprising a nickel sleeve having an inner surface and an outer surface and opposite sharp ends, and hard rubber layer means bonded to said outer surface and having end portions extending beyond said opposite ends of said nickel sleeve and having inner surfaces on said end portions which are substantially in line with said inner surface of said nickel sleeve for limiting the possibility of the nickel sleeve of cracking at said sharp ends and for covering said sharp ends to protect the hands of workmen from being cut.

2. A printing sleeve as set forth in claim 1 wherein said nickel sleeve is between about 0.005 and 0.007 inches thick.

3. A printing sleeve as set forth in claim 2 wherein said hard rubber layer means is an EPDM compound.

4. A printing sleeve as set forth in claim 1 wherein said hard rubber layer means is an EPDM compound having a Shore A hardness of between about 85 and 98.

5. A printing sleeve as set forth in claim 1 wherein said hard rubber layer means is an EPDM compound having a Shore A hardness of between about 90 and 95.

6. A printing sleeve as set forth in claim 1 wherein said hard rubber layer means is an EPDM compound having a Shore A hardness of between about 85 and 98, a tensile strength of between about 1700 and 2300 psi, a Young's modulus of between about 21,000 and 25,000 psi, a 100% modulus of stretchability of between about 1700 and 2200 psi, an elongation of between about 40% and 120%, and a coefficient of expansion of between about 0.0001 and 0.00001 inches per inch per degree Centigrade.

7. A printing sleeve as set forth in claim 1 wherein said hard rubber layer means is between about 0.040 to 0.060 inches thick at said end portions which extend beyond said ends of said nickel sleeve.

8. A printing sleeve as set forth in claim 7 wherein said nickel sleeve is between about 0.005 and 0.007 inches thick, and wherein said hard rubber layer means overlying said outer surface of said sleeve is between about 0.030 and 0.055 inches thick.

9. A printing sleeve as set forth in claim 7 wherein said hard rubber layer means is an EPDM compound.

10. A printing sleeve as set forth in claim 7 wherein said hard rubber layer means is an EPDM compound having a Shore A hardness of between about 85 and 98.

11. A printing sleeve as set forth in claim 7 wherein said hard rubber layer means is an EPDM compound having a Shore A hardness of between about 90 and 95.

12. A printing sleeve comprising a nickel sleeve having an inner surface and an outer surface and opposite ends, and hard rubber layer means bonded to said outer surface and having end portions extending beyond said opposite ends of said nickel sleeve and having inner surfaces on said end portions which are substantially in line with said inner surface of said nickel sleeve and said end portions being expandable by air pressure in substantially the same manner and substantially the same amount as said nickel sleeve.

13. A printing sleeve comprising a nickel sleeve having an inner surface and an outer surface and opposite sharp ends, and hard rubber layer means bonded to said outer surface for an extended distance away from one of said opposite sharp ends, said hard rubber layer means having at least one end portion extending beyond said one of said opposite sharp ends of said nickel sleeve and having an inner surface on said at least one end portion which is substantially in line with said inner surface of said nickel sleeve for limiting the possibility of the nickel sleeve of cracking at said sharp end where said at least one end portion is located and for covering said sharp end where said at least one end portion is located to protect the hands of workmen from being cut.

14. A printing sleeve as set forth in claim 13 wherein said nickel sleeve is between about 0.005 and 0.007 inches thick.

15. A printing sleeve as set forth in claim 14 wherein said hard rubber layer means is an EPDM compound.

16. A printing sleeve as set forth in claim 13 wherein said hard rubber layer means is an EPDM compound having a Shore A hardness of between about 85 and 98.

17. A printing sleeve as set forth in claim 13 wherein said hard rubber layer means is an EPDM compound having a Shore A hardness of between about 85 and 98, a tensile strength of between about 1700 and 2300 psi, a Young's modulus of between about 21,000 and 25,000 psi, a 100% modulus of stretchability of between about 1700 and 2200 psi, an elongation of between about 40% and 120%, and a coefficient of expansion of between about 0.0001 and 0.00001 inches per inch per degree Centigrade.

18. A printing sleeve as set forth in claim 13 wherein said hard rubber layer means is between about 0.040 to 0.060 inches thick at said end portion.

19. A printing sleeve as set forth in claim 18 wherein said nickel sleeve is between about 0.005 and 0.007 inches thick, and wherein said hard rubber layer means overlying said outer surface of said nickel sleeve is between about 0.030 and 0.055 inches thick.

20. A printing sleeve as set forth in claim 18 wherein said hard rubber layer means is an EPDM compound.

21. A printing sleeve as set forth in claim 18 wherein said hard rubber layer means is an EPDM compound having a Shore A hardness of between about 85 and 98.

22. A printing sleeve comprising a nickel sleeve having an inner surface and an outer surface and opposite ends, and hard rubber layer means bonded to said outer surface for an extended distance away from one of said opposite ends, said hard rubber layer means having at least one end portion extending beyond said one of said opposite ends of said nickel sleeve and having an inner surface on said at least one end portion which is substantially in line with said inner surface of said nickel sleeve and said end portion being expandable by air pressure in substantially the same manner and substantially the same amount as said nickel sleeve.

* * * * *

UNITED STATES PATENT AND TRADEMARK OFFICE

CERTIFICATE OF CORRECTION

PATENT NO. : 5,577,443
DATED : November 26, 1996
INVENTOR(S) : Richard E. Songer It is certified that error appears in the above-indentified patent and that said Letters Patent is hereby corrected as shown below:

Column 2, line 44, before "workmen" delete "a".

Column 4, line 32, change "27" to --20--;

line 50, after "pattern" insert --32--;

line 54, change "21" to --31--.

Signed and Sealed this

Eleventh Day of February, 1997

Bruce Lehman

*Attest:*

BRUCE LEHMAN

*Attesting Officer*

*Commissioner of Patents and Trademarks*